US009361742B2

(12) United States Patent
Pececnik

(10) Patent No.: US 9,361,742 B2
(45) Date of Patent: Jun. 7, 2016

(54) HIGHLY SECURE COMBINATION LOCK SYSTEM

(71) Applicant: Joze Pececnik, Smarca (SI)

(72) Inventor: Joze Pececnik, Smarca (SI)

( * ) Notice: Subject to any disclaimer, the term of this patent is extended or adjusted under 35 U.S.C. 154(b) by 0 days.

(21) Appl. No.: 14/526,291

(22) Filed: Oct. 28, 2014

(65) Prior Publication Data

US 2016/0117878 A1 Apr. 28, 2016

(51) Int. Cl.
*G07C 9/00* (2006.01)

(52) U.S. Cl.
CPC ..... *G07C 9/00563* (2013.01); *G07C 9/00134* (2013.01); *G07C 9/00174* (2013.01); *G07C 9/00571* (2013.01); *G07C 9/00166* (2013.01)

(58) Field of Classification Search
CPC ..... G07C 9/00174; G07C 2209/08; G07C 9/126; G07C 9/00912; G07C 9/00571; G07C 9/00134; G07C 9/00166; G07C 9/00142; G07C 9/00182; E05B 65/0075; E05B 47/0002; E05B 47/026; E05B 63/00; E05B 37/00; E05B 47/0012; G08B 23/00; B62H 5/20; B60R 25/102
USPC ..... 340/5.6, 5.7, 5.73, 5.1, 5.2, 5.53; 312/215
See application file for complete search history.

(56) References Cited

U.S. PATENT DOCUMENTS

| | | | | |
|---|---|---|---|---|
| 4,577,345 | A | 3/1986 | Abramov | |
| 6,373,967 | B2 | 4/2002 | Pu | |
| 6,498,861 | B1 | 12/2002 | Hamid | |
| 6,950,540 | B2 | 9/2005 | Higuchi | |
| 6,973,565 | B2 | 12/2005 | Couillard | |
| 7,233,686 | B2 | 6/2007 | Hamid | |
| 7,482,907 | B2 * | 1/2009 | Denison | B60R 25/102 340/5.1 |
| 7,564,997 | B2 | 7/2009 | Hamid | |
| 8,201,426 | B2 | 6/2012 | Helm et al. | |
| 8,506,023 | B2 | 8/2013 | Goldie | |
| 8,635,893 | B2 | 1/2014 | Miller et al. | |
| 8,689,591 | B2 | 4/2014 | Elsner et al. | |
| 8,854,180 | B2 | 10/2014 | Bacarella | |
| 2014/0375422 | A1 * | 12/2014 | Huber | G07C 9/00174 340/5.61 |

* cited by examiner

*Primary Examiner* — Ali Neyzari
(74) *Attorney, Agent, or Firm* — Mark A. Litman & Associates, P.A.

(57) ABSTRACT

A combination lock system has a lock body with a central portion and an surrounding portion on a face of the lock system. The central portion has a biometric scanner and the surrounding portion has a set of visible symbols that may be individually activated in sequence to indicate an unlocking code. An intelligent component in communication with the combination lock system is configured to compare scanned biometric data with stored biometric data to confirm a user identity A locking and unlocking component is attached to the lock body and is configured to be unlocked by the unlocking code being provided and the intelligent component confirming the user identity by compared biometric data.

16 Claims, 2 Drawing Sheets

HIGHLY SECURE COMBINATION LOCK SYSTEM

BACKGROUND OF THE INVENTION

1. Field of the Invention

The present invention relates to the field of physical security and locking systems. In particular, the present technology relates to combination locks have a built-in fingerprint recognition scanner in communication with an intelligence function capable of confirming fingerprints provided by the scanner.

2. Background of the Art

Locks and especially combination locks are devices that securely close to prevent entry and often which require a sequence of numbers or symbols provided at the same time or sequentially to open the lock. The locks may be independent portable devices that can be moved from location to location and then placed on an object (e.g., door, gate, vehicle, pet's leash, machinery, appliances, and the like) or may be built into a structure (e.g., a safe, a communication device, storage device, building entrance, vehicle door or operation panel, gaming equipment, vault, secure building areas, control devices in buildings, and the like.).

Numerous locking and security systems have attempted to combine multiple security elements into a single environment. The following references are examples of combined technologies used in security and access control systems.

U.S. Pat. No. 8,854,180 (Bacarella) describes an access controlled storage device with multiple doors, each door having distinct security elements (e.g., biometrics and number pad locks).

U.S. Pat. No. 8,689,591 (Elsner) describes a personal security safe having a biometric scanner connected to an actuated locking device.

U.S. Pat. No. 8,635,893 (Miller) describes a high security lock having a biometric scanner connected to a bolt action actuated locking device.

U.S. Pat. No. 8,506,023 (Goldie) describes a handgun safe which is disclosed to have alternative security options, such as a biometric scanner, electronic lock or other security device.

U.S. Pat. No. 8,201,426 (Helm) discloses a system, method and apparatus for securing valuables having distinct combination pad and biometric reader.

U.S. Pat. Nos. 7,564,997, 7,233,686 and 6,498,861 (Hamid) show extraction of hash string values from biometric scans to compare the hash values against unique stored values for individual users.

U.S. Pat. No. 6,973,565 (Couillard) discloses a biometrically secured memory integrated circuit. A biometric sensing device and an integrated circuit are irremovably bonded together so that the sensing device and integrated circuit form a single physical unit.

U.S. Pat. No. 6,950,540 (Higuchi) describes a fingerprint scanning apparatus and method of scanning fingerprints for biometric identification and security, U.S. Pat. No. 6,373,967 (Pu) discloses a biometric combination lock in which sequences of fingerprints must be recognized in a particular order.

U.S. Pat. No. 4,577,345 (Abramov) discloses an early format for fingerprint biometric sensing.

Better designed locking and security systems are desired. Each document referenced within this Patent Document are incorporated by reference in their entirety, especially for their respective technical disclosure which may be incorporated into the practice of the present technology

SUMMARY OF THE INVENTION

A combination lock system has:

a lock body with a central portion and an surrounding portion on a face of the lock system;

the central portion has a biometric scanner;

the surrounding portion has a set of visible symbols that may be individually activated in sequence to indicate an unlocking code;

an intelligent component in communication with the combination lock system is configured to compare scanned biometric data with stored biometric data to confirm a user identity; and a locking and unlocking component attached to the lock body is configured to be unlocked by the unlocking code being provided and the intelligent component confirming the user identity by compared biometric data.

DETAILED DESCRIPTION OF THE INVENTION

Figure 1:
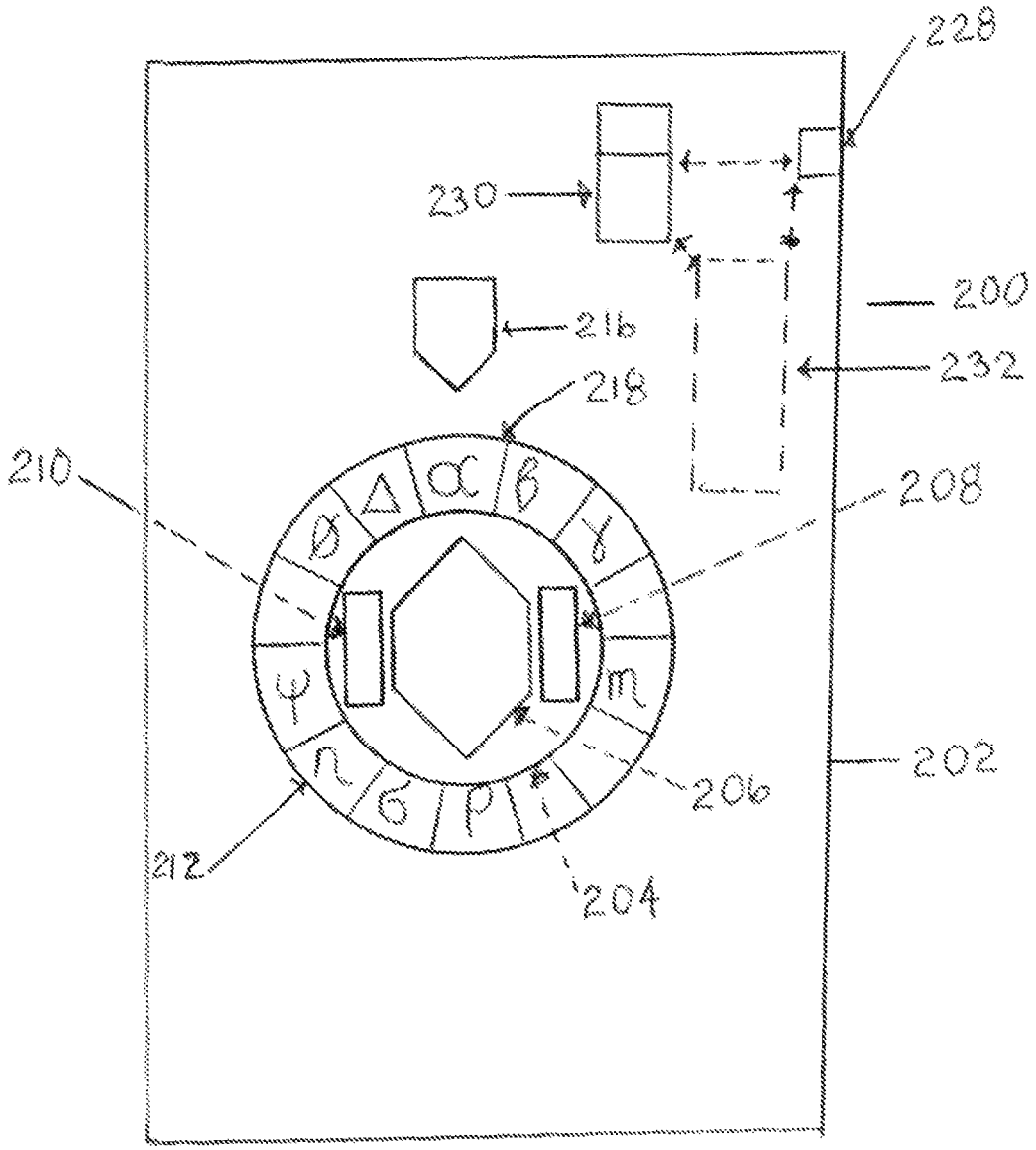
FIG. 1 shows a front view of a lock system of the present technology embedded in a vault door.

A combination lock system and method of use are provided as either a moveable locking element or a built-in locking element. The combination lock system has:

a) a lock body having a central portion and an surrounding portion on a face of the lock system.

The lock body should be sturdy enough to resist tampering, breakage and simple destructive damage. A sturdy impact resistant material (e.g., polymers such as nylon, high density polyester, reinforced polymers, shatter resistant ceramics and composites, and preferably metals) may be used as the structural body.

the central portion has a biometric scanner.

The scanner may be a voice reader, retinal scanner, facial recognition scanner, and preferably a fingerprint scanner. There are commercially components that can be used for this component. The fingerprint scanner preferably has a plate against which a finger is placed and either ambient radiation or radiation emitted below and through the plate (UV, visible and/or infrared) is reflected off the fingerprint and a radiation sensor reads the reflected information to generate data sent to an intelligent component that converts the generated data or compares the generated data to a data base of approved fingerprints.

the surrounding portion comprising a set of visible symbols that may be individually activated in sequence to indicate an unlocking code.

The surrounding portion may look like a typical exterior distribution of symbols (letters, numbers, symbols or images) in a relatively equal 360° display. Individual activation may be accomplished in numerous ways. A simple way is as standard face rotation of the distribution of symbols to a pointer (tumbler shifting location) position to progressively place a sequence of the symbols in the pointer location (e.g., in a left-right-left or right-left-right) type of alternating rotation. Another way to activate individual symbols is to have the individual symbols flex upon contact to cause an electrical contact between individual symbol elements and a lower contact pad. The fingerprint plate may also act as a display screen to show which symbol has been depressed, so that the locking system can be used in darker conditions. The symbols may be backlit on the circular front display to assist viewing, and then the fingerprint screen can display confirmation of symbol being pressed. The symbol may be partially flexed or depressed and the screen displaying the symbol, without the confirmation display of the partial symbol selection not being entered or received as a selection in the sequence until the pressure on the symbol is sufficient to make the selection a confirmed symbol selection.

an intelligent component configured to compare scanned biometric data with stored biometric data to confirm a user identity.

The intelligent component may be any hardware or hardware containing software that can receive signals from the biometric scanner and compare that received data to stored or accessible biometric information which can be used to identify an approved and recognized individual as an authorized user of the lock. The intelligent component may be within the lock device or be in communication with sensors and signal generating components within the lock system. The intelligent component may be a microprocessor, field programmable gated array (FPGA), application specific integrated circuit (ASIC) or wired or wireless communication element (transducer, wireless transmitter and receiver) to the intelligent component. There are different advantages and options in the performance of the technology that accompanies each of the systems or components. Microprocessors and FPGAs can have comparison information for authorized users updated (additions or subtractions) even when the locking device is permanently embedded in another structure (e.g., vault or safe door, machinery, etc.). This is clearly available where there is an in-out (I/O) port providing information communication to the intelligent component. It is also possible for the microprocessor I/O port is in communication to a cradle for a smart chip, ID card, wifi card with access to biometric data input, and the like. By providing this amendable database, especially with portable personal data (e.g., the smart chip or ID card), each individual with physical access to the locking device can insert his personal identification biometric information into the cradle in the locking system, feed the personal data into the intelligent component so that the fingerprint scanner can identify that new user. It is desirable that the biometric information from the portable personal data device be encrypted or in a unique format for acceptance by the intelligent component.

a locking and unlocking component attached to the lock body that can be unlocked by the unlocking code being provided and the intelligent component confirming the user identity.

The locking and unlocking element may require physical manipulation or open and close, as is typical with most padlocks, bicycle lock, handle locks and the like, or the locking and unlocking action may be spring driven, electronically driven or hydraulically powered to cause status change without or with only partial physical force by a user. The proper entry of an accepted fingerprint scan and sequence of symbol entry triggers availability of manual locking/unlocking or triggers the automated locking/unlocking motion.

The lock system may use set of visible symbols that can be individually activated by rotation of the surrounding portion and alignment of individual visible symbols with a pointing position as is typically seen in many tumbler-based, handheld locks as are seen on gym lockers and the like.

The lock system may have the set of visible symbols may be individually activated by physical contact with individual visible symbols which individual activation is sensed and indicated to the intelligent component within or in communication with the lock system body.

The lock system intelligent component may be configured to require a sequence of first fingerprint confirmation of the user identity before second individual activation in sequence can indicate an unlocking code, or to require a second sequence of fingerprint confirmation of the user identity after individual activation in sequence can indicate an unlocking code. Alternatively, the intelligent component is configured to require a sequence of fingerprint confirmation of the user identity intermediate of two stages of individual activation in sequence to indicate an unlocking code. For example, with a five symbol recognition code required, a first set of symbols (e.g., 1, 2, 3 or 4) may be needed before fingerprint identification and then a second set of symbols (4, 3, 2 or 1, respectively) must be entered to complete the unlocking procedure.

The lock system may have the intelligent component within the lock body or be in communication with the intelligent component locally accessed and in communication with the lock body, as with the lock body embedded in a safe door and the intelligent component located at a different position within the door. As mentioned above, the lock system can be constructed where the lock body has an I/O port with an available communication link to the intelligent component.

The lock system may have the intelligent component configured to accept information on user identity in the form of a biometric database to which scanned biometric data may be compared for confirmation of the user identity. This has been described above, with respect to an I/O port, smart chip cradle and the like. The biometric data preferably consists of fingerprint data, although voice recognition (e.g., specific words in a specific sequence in a specific time interval) and retinal scan data may be used.

The lock system may offer additional functional and security features. There may be at least two distinct light emission patterns that are available within the lock system (within the lock body or adjacent thereto) and failure of either fingerprint recognition or any failure within the sequence of symbols may cause a distinct light emission that indicates a failure at a stage of unlocking the lock system. For example, the at least two distinct light emission patterns are provided by at least two light emitting diodes, which may be as simple as on-off, one n, and two on. The at least two diodes may also be distinct signaling colors such as green for a successful data entry (e.g., matched fingerprint scan, or individual symbol in its proper sequence) or red for an unsuccessful data entry. Any failed data entry requires initiation of all unlocking information from a beginning procedure, so that even previously correctly entered data is obsolete in a future locking/unlocking procedure.

The intelligent component may be programmed so that failure to provide the sequence of individual visible symbols a predetermined number of times initiates a shut-down in at least unlocking procedures.

The lock system may include steps and hardware/software activation of individual symbols causes lights behind individual symbols to illuminate individual symbols being activated. In this way, locking and unlocking in dim conditions may be enabled. Benefits of this system, with partial (incomplete, un-entered) symbol identification (as described above) can be used. In this method, there are two sequential contact points, where only the second contact point accomplishing a committed symbol entry. This can be done with a first contact point lighting up the symbol on the outer ring of the lock body and/or causing that symbol to be displayed on the fingerprint scanning screen (or an adjacent second screen) so that the user can confirm correctness of a symbol before permanent entry by pressing the symbol segment to the second contact. This system can prevent or reduce errors in the symbol entry. The symbol may also be displayed on the fingerprint screen or second screen with similar double contact points.

Referring to the figures can assist in further appreciation and understanding of the present technology.

FIG. 1 shows a front view of a lock system 200 of the present technology embedded in a vault door 202. The lock system 200 is shown with a center dial 204 having a fingerprint scanning element 206 with two distinct light emitting areas 208 and 210 on opposite sides of the center dial 204. The center dial 204 may be rotated to turn the outside symbol-carrying display area 212 or the outside symbol-carrying display area 212 may be rotated about a fixed center dial 204 so that individual symbols e.g., 214) may be positioned at a pointing element 216 to identify an entered symbol 218. A smart chip cradle 230 in communication with a microprocessor 232 is shown on the vault door 202 with a connection link or I/O port 228 accessing the microprocessor 232.

Figure 2:
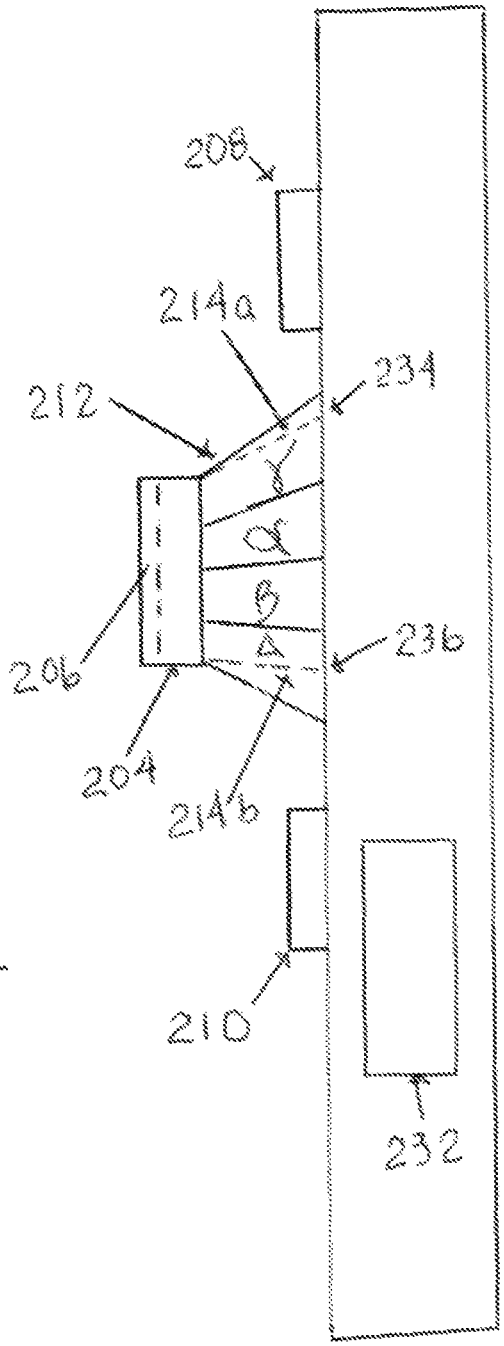
FIG. 2 shows a side view of a lock system of the present technology embedded in a vault door.

FIG. 2 shows a side view of a lock system 200 of the present technology embedded in a vault door 202. The lock system 200 is shown with a center dial 204 having a fingerprint scanning element 206 with two distinct light emitting areas 208 and 210 on opposite sides of the center dial 204. The outside symbol-carrying display area 212 is shown with a first symbol 214*a* partially depressed to a first contact point 234 and a second symbol 214*b* is completely depressed to a second contact point 236 that will cause the symbol 214*b* to be entered to the microprocessor 232.

The fingerprint data may be scanned, stored, compared and transmitted in various forms. Actual images may be compared, as with multi-point comparisons (e.g., 5-, 6-, 7-, 8-, 9- and 10-point correspondence comparisons as known in the art), The fingerprints may also be used to create hash values which are then stored, generated by a scan and then compared to confirm identity of a user. A system for generating a password (in this case the sequence of symbols effecting a portion of the unlocking combination), comprising: a means (e.g., image scanning and fiducial markings) for determining a location of an alignment feature within a biometric information sample from an individual; means (imaging and scanning technology for example) for extracting features from the biometric information sample, especially defined numbers of alignment, recognition and point correspondence (as is a legal requirement with identification recognition for evidentiary standards); means (software, hardware, such as ASICs, FPGAs, chips, etc.) for determining from the extracted features a first string of symbols based on locations of extracted features within the biometric information sample relative to the alignment feature; means for determining a plurality of error strings in dependence upon predetermined parameters defining an error region about the extracted first string; means for hashing the first string and at least some of the error strings from the determined plurality of strings to produce a plurality of hash values; and means for comparing each produced hash value from the plurality of hash values with a predetermined stored hash value for determining a hash value from the plurality of hash values indicative of a match, wherein upon a match between a hash value from the plurality of hash values and the stored hash value, the string from which the matching hash value was derived is provided as the generated password (combination of the lock system).

Point recognition processes and systems may be provided by selecting a first feature point in the image data; identifying a plurality of neighborhood feature points closest in distance to the first feature point, wherein the plurality of neighborhood feature points closest in distance to the first feature point includes a P-neighborhood (point neighborhood of defined distance), the P-neighborhood including P number of neighborhood feature points closest in distance to the first feature point and feature points in the P-neighborhood are determined by storing all feature points of the image data in a feature point table, and determining P number of feature points closest to the location of the first feature point within the feature point table; generating a plurality of point vectors, each point vector computed based on distance and angle between a particular neighborhood feature point and the first feature point; and aggregating the plurality of point vectors to generate a fingerprint corresponding to the first feature point. In one embodiment, the distances and angles of each point vector is normalized in relation to the anchor point (arbitrarily or statistically or automatically selected from the image, such as a distinct fingerprint feature nearest a center of the fingerprint image). For example, the value of the distance between the C-Point and each feature point of the P-neighborhood is divided by the distance between the C-Point and the anchor point. The angle values are also, in some instances, normalized in a similar fashion.

A hash function is then run over all the point vectors of the P-neighborhood. The hash function, in some instances, is applied in a predetermined direction. For example, one of the directions (vectors) may be employed to apply the hash function. Any hash function known to people skilled in the art may be applied to compute one final hash value that corresponds to the point vectors of the P-neighborhood of a particular C-Point. In some instances, the point vector corresponding to the anchor point may be excluded from the hash generation, further improving the overall computational efficiency. In one embodiment, the single hash value is an integer calculated based on the point vectors of a particular P-neighborhood. The single hash value is designated as the fingerprint corresponding to the C-Point and can be used to define a combination.

The software and hardware technology may operate as a system for text-based (in this case available symbols in the combination) biometric authentication comprising: a computer configured as a server, said server including at least a data base and being configured to store within said database at least a data document (symbol sequence) gallery comprising data documents (fingerprint identification content), each data document (the fingerprint recognition content) corresponding to a different individual and including enrollment biometric symbol sequences; and at least one client system operationally coupled to said server, said client system configured to at least capture biometric data from an individual, said server being further configured to generate a biometric image from biometric data, the biometric image including biometric features, superimpose a positional relationship medium on the biometric image, the positional relationship medium including cells, each cell being described with a word derived from the positional relationship medium, adjacent cells include a common border, establish an overlapping border region between respective adjacent cells, determine a biometric feature included in the biometric features is positioned in an overlapping border region, derive a word for each adjacent cell associated with the overlapping border region in which the biometric feature is positioned, and compare the derived words against the enrollment biometric words in each data document, and identify a data document (personal identification) as a matching data document (identification) when a derived word (combination on the lock system) matches an enrollment biometric word (stored combination in the lock system).

Some security measures should be taken with respect to the use of lighting behind individual symbols (numbers), sequential symbols (numbers) and completed sequences of symbols (numbers). The lighting should not be available by a slow progressive stop at sequential positions of symbols (e.g., numbers). This is to prevent someone from slowly and progressively turning the dial (even once a fingerprint has been provided) until a symbol lights up (by backlighting or other illumination), and then moving towards a next number in the sequence until all numbers have been obtained. The microprocessor may require time limits on each intermediate stop position, collective time limits on sequences of intermediate stop positions (before a correct stop position is reached), and also a collective limit on numbers of attempts to input the correct sequence of symbols with repeated failures. For example, after a fingerprint has been entered, the microprocessor may stop an unlocking procedure when more than two consecutive symbol stops are made that are not in the proper sequence, and the stops last long enough to be more than an effort to move towards a proper symbol in the sequence. This may be enhanced by requiring a symbol position in the appropriate sequence to be stopped in a selection position for a distinct period of time (e.g., 2 seconds) before the backlighting indicating acceptance occurs. In this way, once symbols are attempted to be sequentially entered, if a non-sequential code symbol is paused at for more than 2 seconds, the entire unlocking procedure will be halted and must be restarted. If more than 3 sequential failed attempts are made, the lock can be completely restricted from any unlocking attempts for a defined time period (e.g., 15 minutes, 30 minutes, 45 minutes, 1 hour, 1.5 hours, etc.).

Other variations, equivalents and modifications may be practiced by one skilled in the art and the system and method will remain within the scope of the generic technology described herein.

What is claimed is:

1. A combination lock system comprising:

a lock body having a central portion and a surrounding portion on a face of the lock system;

the central portion comprising a biometric scanner;

the surrounding portion comprising a set of visible symbols that are configured to be individually activated in sequence to indicate an unlocking code;

an intelligent component configured to compare scanned biometric data with stored biometric data to confirm a user identity; and a locking and unlocking component attached to the lock body that is configured to be unlocked by the unlocking code being provided and the intelligent component confirming the user identity.

2. The combination lock system of claim 1 wherein the set of visible symbols may be individually activated by rotation of the surrounding portion and alignment of individual visible symbols with a pointing position.

3. The combination lock system of claim 1 wherein the set of visible symbols may be individually activated by physical contact with individual visible symbols which is sensed and indicated to the intelligent component.

4. The combination lock system of claim 1 wherein the intelligent component is configured to require a sequence of fingerprint confirmation of the user identity before individual activation in sequence can indicate the unlocking code.

5. The combination lock system of claim 1 wherein the intelligent component is configured to require a sequence of fingerprint confirmation of the user identity after individual activation in sequence can indicate the unlocking code.

6. The combination lock system of claim 1 wherein the intelligent component is configured to require a sequence of fingerprint confirmation of the user identity intermediate of individual activation in sequence can indicate the unlocking code.

7. The combination lock system of claim 1 wherein the intelligent component is within the lock body.

8. The combination lock system of claim 2 wherein the intelligent component is within the lock body.

9. The combination lock system of claim 3 wherein the intelligent component is within the lock body.

10. The combination lock system of claim 7 wherein the lock body has an I/O port with an available communication link to the intelligent component.

11. The combination lock system of claim 10 wherein the intelligent component is configured to accept information on user identity in the form of a biometric database to which the scanned biometric data may be compared for confirmation of the user identity.

12. The combination lock system of claim 11 wherein the biometric data consists of fingerprint data.

13. The combination lock system of claim 1 wherein at least two distinct light emission patterns are available and failure of either fingerprint recognition or any failure within the sequence of symbols causes a distinct light emission that indicates a failure at a stage of unlocking the lock system.

14. The combination lock system of claim 13 wherein the at least two distinct light emission patterns are provided by at least two light emitting diodes.

15. The combination lock system of claim 13 wherein the intelligent component is programmed so that failure to provide the sequence of individual visible symbols a predetermined number of times initiates a shut down in unlocking procedures.

16. The combination lock system of claim 2 wherein activation of individual symbols causes lights behind individual symbols to illuminate individual symbols being activated.

* * * * *